US011515666B2

(12) United States Patent
Henry et al.

(10) Patent No.: US 11,515,666 B2
(45) Date of Patent: Nov. 29, 2022

(54) SYSTEM FOR VEHICLE BATTERY CHARGING AROUND CHARGE-ADVERSE TIME PERIODS

(71) Applicant: TE Connectivity Services GmbH, Schaffhausen (CH)

(72) Inventors: Randall Robert Henry, Lebanon, PA (US); Brandon Michael Matthews, McAlisterville, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 1 day.

(21) Appl. No.: 17/124,042

(22) Filed: Dec. 16, 2020

(65) Prior Publication Data

US 2022/0190513 A1 Jun. 16, 2022

(51) Int. Cl.

| | |
|---|---|
| ***H01R 13/627*** | (2006.01) |
| ***H01R 13/6582*** | (2011.01) |
| ***H01R 24/60*** | (2011.01) |
| ***H01R 12/72*** | (2011.01) |
| ***H01R 12/70*** | (2011.01) |

(52) U.S. Cl.

CPC ..... *H01R 13/6271* (2013.01); *H01R 12/7023* (2013.01); *H01R 12/721* (2013.01); *H01R 12/727* (2013.01); *H01R 13/6582* (2013.01); *H01R 24/60* (2013.01)

(58) Field of Classification Search

CPC ..... H01R 13/6271; H01R 13/6582; H01R 12/7023; H01R 12/721; H01R 12/727; H01R 24/60

USPC ..... 439/352

See application file for complete search history.

(56) References Cited

U.S. PATENT DOCUMENTS

| | | | | |
|---|---|---|---|---|
| 5,971,775 | A | 10/1999 | Tor et al. | |
| 6,695,647 | B2 | 2/2004 | Tsai | |
| 7,175,444 | B2 * | 2/2007 | Lang | H01R 12/7005 439/76.1 |
| 7,175,465 | B1 * | 2/2007 | Tsai | H01R 13/6275 439/352 |
| 7,226,314 | B2 * | 6/2007 | Lang | H01R 13/6582 439/607.04 |
| 7,303,438 | B2 * | 12/2007 | Dawiedczyk | H01R 12/7023 439/607.53 |

(Continued)

FOREIGN PATENT DOCUMENTS

| | | | | |
|---|---|---|---|---|
| CN | 201887197 U | * | 6/2011 | H01R 13/6471 |
| JP | 4133669 A | | 3/2005 | |

*Primary Examiner* — Peter G Leigh

(57) ABSTRACT

A communication system includes a plug connector mated with a receptacle connector. The receptacle connector includes a housing holding a contact assembly. The housing includes a front housing that receives an inner housing, which receives contact holders and receptacle contacts of the contact assembly. The receptacle connector housing includes a height profile defined between top and bottom walls with a housing latch and guide pockets contained within the height profile. The plug connector includes a housing holding a cable assembly with a circuit card received in a card slot of the receptacle housing. The plug connector housing includes alignment embossments received in the guide pockets and latches coupled to the alignment embossments are latchably coupled to the receptacle connector. The latches are contained within a height profile of the plug connector housing.

22 Claims, 8 Drawing Sheets

(56) References Cited

U.S. PATENT DOCUMENTS

| | | | | |
|---|---|---|---|---|
| 7,651,341 | B2 * | 1/2010 | Wu | H01R 13/6335 439/76.1 |
| 7,997,909 | B2 * | 8/2011 | Xu | H01R 13/6658 439/607.57 |
| 8,303,326 | B1 * | 11/2012 | McKee | H01R 13/6275 439/358 |
| 9,437,949 | B2 | 9/2016 | Behziz et al. | |
| 9,478,910 | B2 * | 10/2016 | Nonen | H01R 13/6335 |
| 9,590,353 | B2 | 3/2017 | Regnier et al. | |
| 9,748,694 | B2 * | 8/2017 | Nonen | H01R 13/6335 |
| 10,608,358 | B2 * | 3/2020 | Hou | H01R 24/60 |
| 2007/0243749 | A1 * | 10/2007 | Wu | H01R 13/6584 439/352 |
| 2011/0065328 | A1 * | 3/2011 | Wu | H01R 13/6658 439/660 |
| 2012/0052699 | A1 | 3/2012 | MacDougall | |

* cited by examiner

SYSTEM FOR VEHICLE BATTERY CHARGING AROUND CHARGE-ADVERSE TIME PERIODS

BACKGROUND OF THE INVENTION

The subject matter herein relates generally to a communication system.

Communication systems, such as routers, servers, supercomputers, and other computing systems, may be large complex systems that have a number of components interconnected to one another through cable assemblies. For example, a backplane communication system may include several daughter card assemblies that are interconnected to a common backplane. The daughter card assemblies include a circuit board having an integrated circuit and one or more electrical connectors that are mounted to the circuit board. The integrated circuit is connected to the electrical connectors through traces of the circuit board. The electrical connector typically includes a housing that holds a two-dimensional array of the electrical contacts. A plug connector is coupled to the electrical connector. Some known systems provide a heat sink or other heat transfer element to dissipate heat from the integrated circuit. Due to the size of the electrical connector and the plug connector, there are size constraints on the size of the heat sink and/or the electrical connectors are mounted a large distance from the integrated circuit, which leads to long circuit traces between the electrical connectors and the integrated circuit.

A need exists for a communication system having a small profile and high density.

BRIEF DESCRIPTION OF THE INVENTION

In one embodiment, a communication system is provided. The communication system includes a receptacle connector includes a contact assembly and a receptacle connector housing holding the contact assembly. The contact assembly includes receptacle contacts arranged in an upper array and a lower array. The receptacle contacts includes spring beams at mating ends of the receptacle contacts. The contact assembly includes contact holders holding the receptacle contacts in the upper array and the lower array. The receptacle connector housing includes a front housing and an inner housing receiving the contact holders and the receptacle contacts. The front housing includes a top wall and a bottom wall forming a cavity therebetween. The front housing includes a card slot at a front of the receptacle connector housing. The inner housing is received in the cavity of the front housing to position the mating ends of the receptacle contacts at the card slot. The front housing retains the contact holders in the inner housing. The front housing includes a housing latch securing the inner housing in the front housing. The receptacle connector housing has guide pockets at the front. The receptacle connector housing includes a height profile defined between the top wall and the bottom wall. The housing latch is contained within the height profile. The inner housing is contained within the height profile. The guide pockets are contained within the height profile. The communication system includes a plug connector mated with the receptacle connector. The plug connector includes a plug connector housing has an upper wall, a lower wall and side walls between the upper and lower walls forming a cavity. The cavity receives a cable assembly of the plug connector. The cable assembly has cables electrically connected to a circuit card. The circuit card has a card edge and plug contacts proximate to the card edge. The circuit card is received in the card slot of the receptacle connector to mate the plug contacts with the receptacle contacts. The plug connector housing includes alignment embossments extending forward from the side walls. The alignment embossments is received in the guide pockets of the receptacle connector to align the plug connector with the receptacle connector prior to loading the circuit card in the card slot. The plug connector includes latches coupled to the alignment embossments is latchably coupled to the receptacle connector, wherein the latches are contained within a height profile of the plug connector housing defined between the upper wall and the lower wall of the plug connector housing.

In another embodiment, a plug connector is provided. The plug connector includes a cable assembly including cables electrically connected to a circuit card. The circuit card has a card edge and plug contacts proximate to the card edge. The circuit card is configured to be received in a card slot of a receptacle connector. The plug connector includes a plug connector housing including an upper wall, a lower wall and side walls between the upper and lower walls forming a cavity. The cavity receives the circuit card. The plug connector housing includes a height profile defined between the upper wall and the lower wall. The plug connector housing includes alignment embossments extending forward from the side walls. The alignment embossments are configured to interface with the receptacle connector to align the plug connector with the receptacle connector prior to loading the circuit card in the card slot. The plug connector includes latches coupled to the alignment embossments. The latches are configured to be latchably coupled to the receptacle connector. The latches are contained within the height profile of the plug connector housing.

In a further embodiment, a receptacle connector for a communication system is provided. The receptacle connector for a communication system includes a contact assembly including receptacle contacts arranged in an upper array and a lower array. the contact assembly includes contact holders holding the receptacle contacts in the upper array and the lower array. The receptacle contacts include spring beams at mating ends of the receptacle contacts. The receptacle connector for a communication system includes a receptacle connector housing holding the contact assembly. The receptacle connector housing includes a front housing and an inner housing. The inner housing receives the contact holders and the receptacle contacts. The front housing includes a top wall and a bottom wall forming a cavity therebetween. The front housing includes a card slot at a front of the receptacle connector housing configured to receive a plug circuit card of a plug connector. The inner housing is received in the cavity of the front housing to position the mating ends of the receptacle contacts at the card slot for mating with the plug circuit card. The front housing retains the contact holders in the inner housing. The front housing includes a housing latch securing the inner housing in the front housing. The receptacle connector housing has a guide pocket configured to receive the plug connector to locate the plug connector relative to the receptacle connector. The receptacle connector housing includes a height profile defined between the top wall and the bottom wall. The housing latch is contained within the height profile. The inner housing is contained within the height profile. The guide pocket is contained within the height profile.

DETAILED DESCRIPTION OF THE INVENTION

Figure 1:
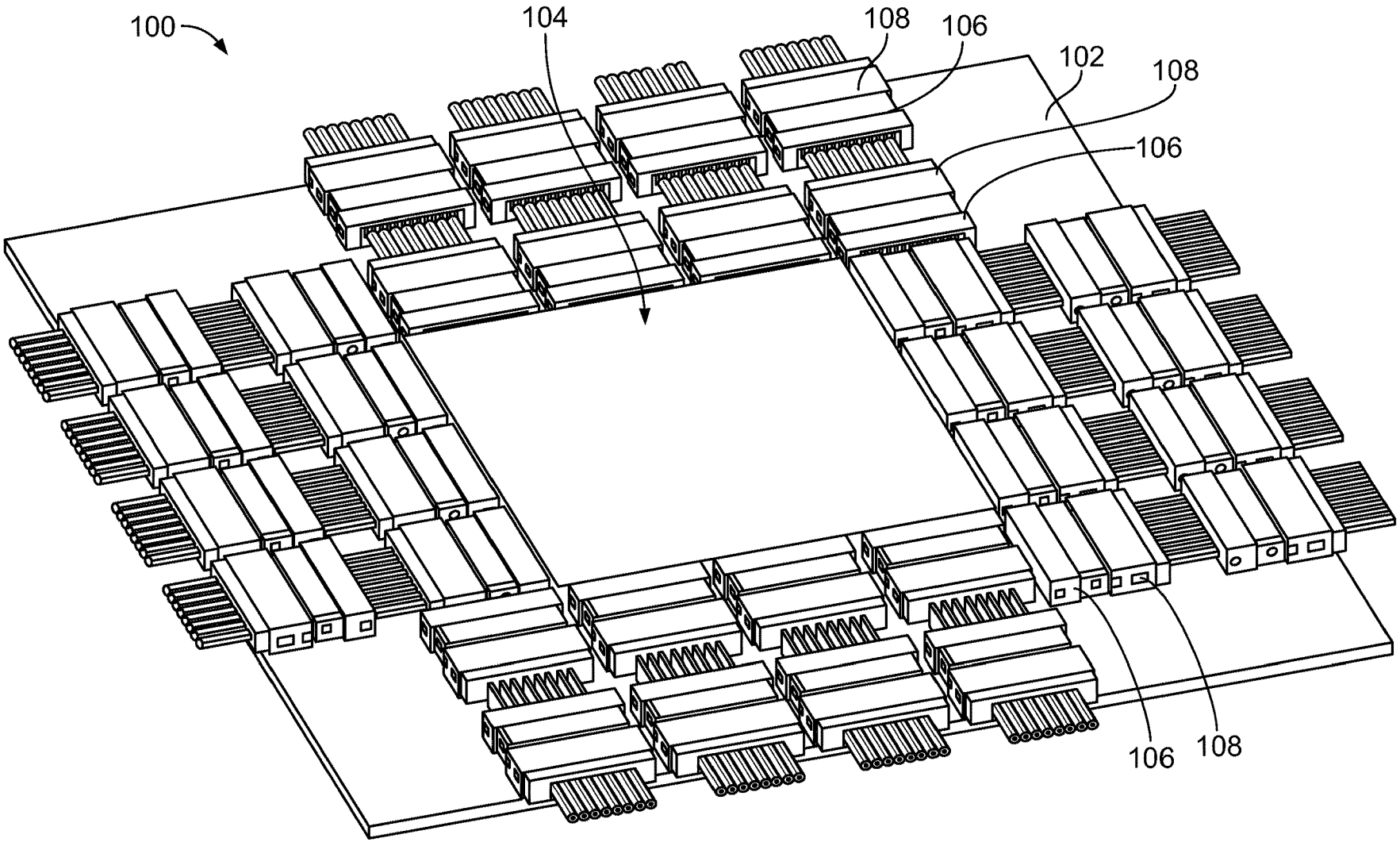
FIG. 1 is a perspective view of a communication system formed in accordance with an exemplary embodiment.
Figure 2:
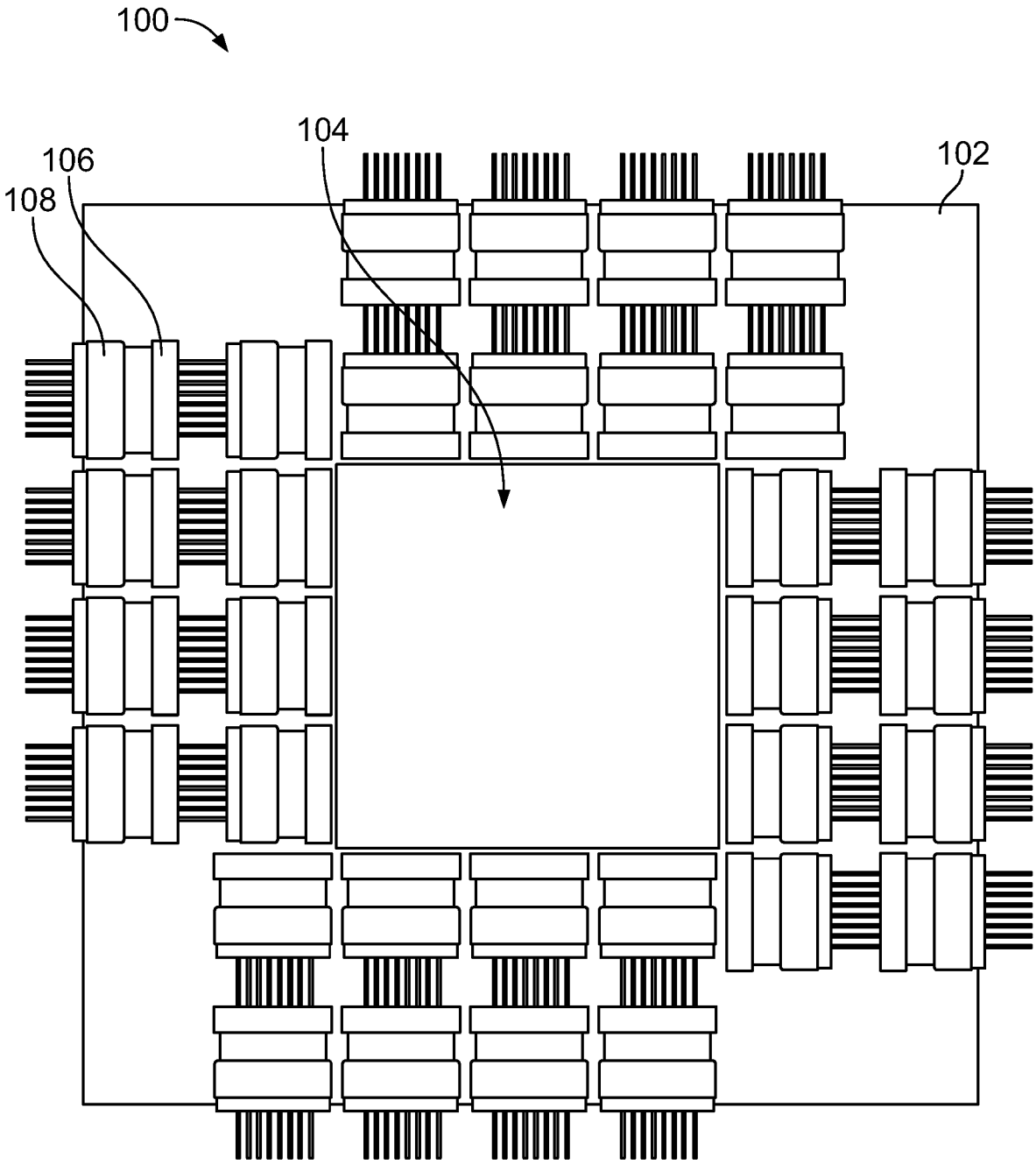
FIG. 2 is a top view of the communication system in accordance with an exemplary embodiment.

FIG. 1 is a perspective view of a communication system 100 formed in accordance with an exemplary embodiment. FIG. 2 is a top view of the communication system 100. The communication system 100 includes a circuit board 102 and an electronic package 104 mounted to the circuit board 102. The electronic package 104 may be an integrated circuit, such as an application-specific integrated circuit (ASIC), a chip, a microprocessor, and the like. The circuit board 102 may be a host circuit board, such as a motherboard, daughtercard, and the like. In other various embodiments, the circuit board 102 may be a package board of the electronic package 104, such as a board that supports the chip of the integrated circuit. In various embodiments, the electronic package 104 may be directly coupled to the circuit board 102, such as soldering the electronic package 104 using a ball grid array of solder balls. In other various embodiments, the electronic package 104 may be coupled to the circuit board 102 using a socket connector.

Electrical connectors are electrically coupled to the circuit board 102 and the electronic package 104 through the circuit board 102. In an exemplary embodiment, the communication system 100 includes a receptacle connector 106 and a plug connector 108 coupled to the corresponding receptacle connector 106. The receptacle connector 106 electrically connects the electronic package 104 with the plug connector 108. In various embodiments, multiple receptacle connectors 106 and multiple plug connectors 108 are provided to provide a large number of data communication lines with the electronic package 104, such as high-speed data communication lines. In the illustrated embodiment, the receptacle connectors 106 and the plug connectors 108 are provided on all four sides of the electronic package 104. Optionally, the receptacle connectors 106 and the plug connectors 108 may be provided in multiple rows, such as two rows on each side of the electronic package 104. The receptacle connectors 106 and the plug connectors 108 are located in close proximity to the electronic package 104, such as to reduce trace lengths of the data communication lines along the circuit board 102.

In the illustrated embodiment, the electronic package 104 is coupled to the top of the circuit board 102 at a primary mating area and the receptacle connectors 106 are coupled to the top of the circuit board 102 at secondary mating areas. Other components may be coupled to the circuit board 102 at tertiary mating areas. The secondary mating areas are in close proximity to the primary mating area, such as immediately adjacent the primary mating area. As such, the receptacle connectors 106 are located in close proximity to the electronic package 104, such as immediately adjacent to the electronic package 104. As such, the circuit traces of the circuit board 102 connecting the receptacle connectors 106 and the electronic package 104 are relatively short. The circuit traces have little signal degradation along the short circuit traces between the electronic package 104 and the receptacle connectors 106. The electronic package 104 may transmit high speed data, low speed data and/or power through the interface between the electronic package 104 and the circuit board 102. The receptacle connectors 106 may transmit high speed data, low speed data and/or power through the interface between the receptacle connectors 106 and the circuit board 102. In an exemplary embodiment, high speed data signals may be transmitted between the receptacle connectors 106 and the electronic package 104.

The electronic package 104 may be any type of component, such as a data communication device. For example, the electronic package 104 may be an integrated circuit, such as an application-specific integrated circuit (ASIC), a chip, a microprocessor, and the like. In other various embodiments, the electronic package 104 may be an electrical connector, such as a high speed differential pair receptacle connector, a header connector, a card edge connector, and the like. The electrical connector may define an interface for interfacing with another mating connector, such as a cable connector, a paddle card connector, or another type of mating connector.

Figure 3:
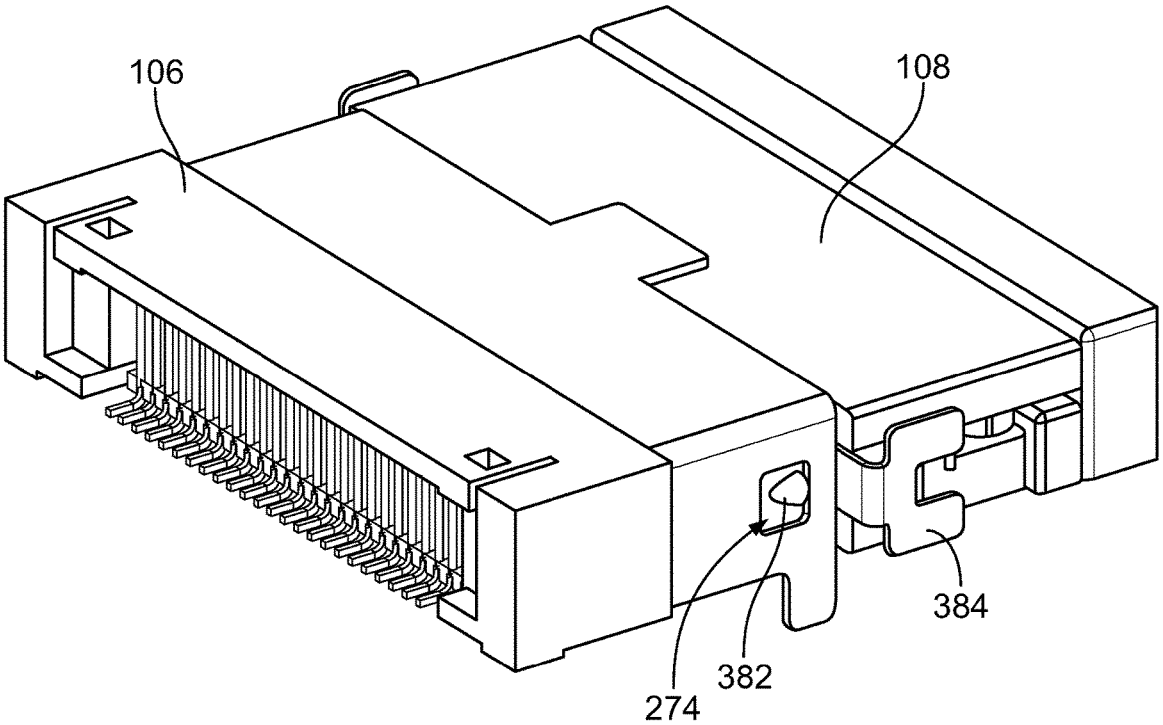
FIG. 3 is a perspective view of a portion of the communication system showing a plug connector coupled to a receptacle connector in accordance with an exemplary embodiment.
Figure 4:
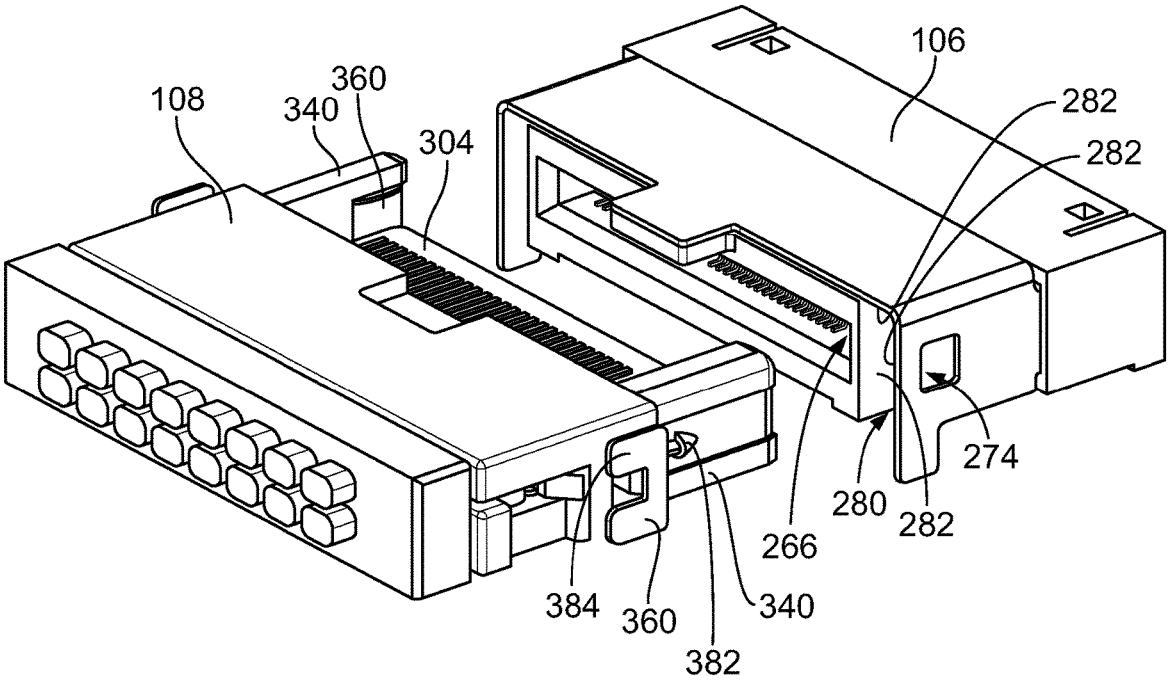
FIG. 4 is a perspective view of a portion of the communication system showing the plug connector poised for coupling to the receptacle connector in accordance with an exemplary embodiment.
Figure 5:
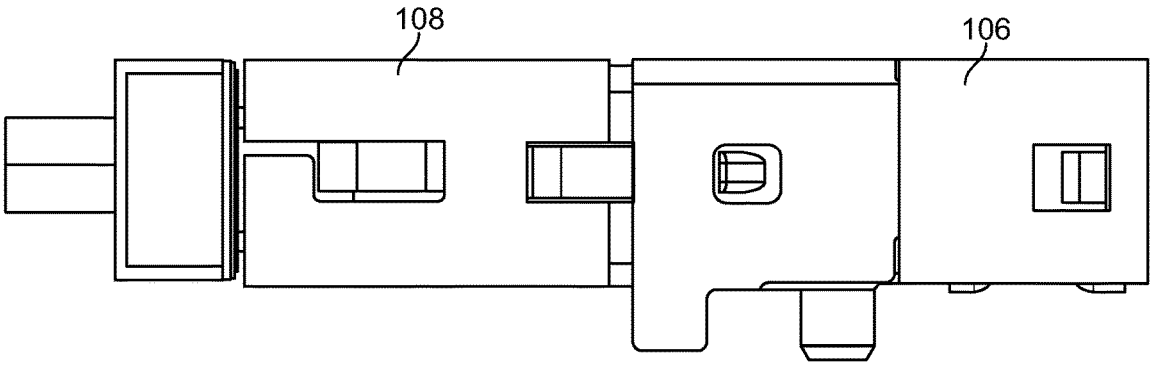
FIG. 5 is a side view of a portion of the communication system showing the plug connector coupled to the receptacle connector in accordance with an exemplary embodiment.

FIG. 3 is a perspective view of a portion of the communication system 100 showing one of the plug connectors 108 coupled to the corresponding receptacle connector 106. FIG. 4 is a perspective view of a portion of the communication system 100 showing one of the plug connectors 108 poised for coupling to the corresponding receptacle connector 106. FIG. 5 is a side view of a portion of the communication system 100 showing one of the plug connectors 108 coupled to the corresponding receptacle connector 106.

In an exemplary embodiment, the plug connector 108 is coupled to the receptacle connector 106 at a separable interface. For example, the plug connector 108 is latchably coupled to the receptacle connector 106. The receptacle connector 106 includes an array of receptacle contacts having separable mating interfaces. The receptacle contacts may define a compressible interface, such as including deflectable spring beams that are compressed when the plug connector 108 is coupled to the receptacle connector 106. The plug connector 108 includes a circuit card configured to be plugged into the receptacle connector 106. The circuit card includes contacts configured to be mated with corresponding receptacle contacts. Cables extend from the plug connector 108, which are electrically connected to the circuit card.

In an exemplary embodiment, the receptacle connector 106 and the plug connector 108 have a low profile height to limit the amount of occupied space above the circuit board 102. The low profile height allows connection of a heat sink or other component to the top of the electronic package, such as to dissipate heat from the chip of the electronic package 104. The low profile height may be similar to the height of the electronic package 104. The cables of the plug connector 108 extend outward from the sides within the low profile of the plug connector 108.

Figure 6:
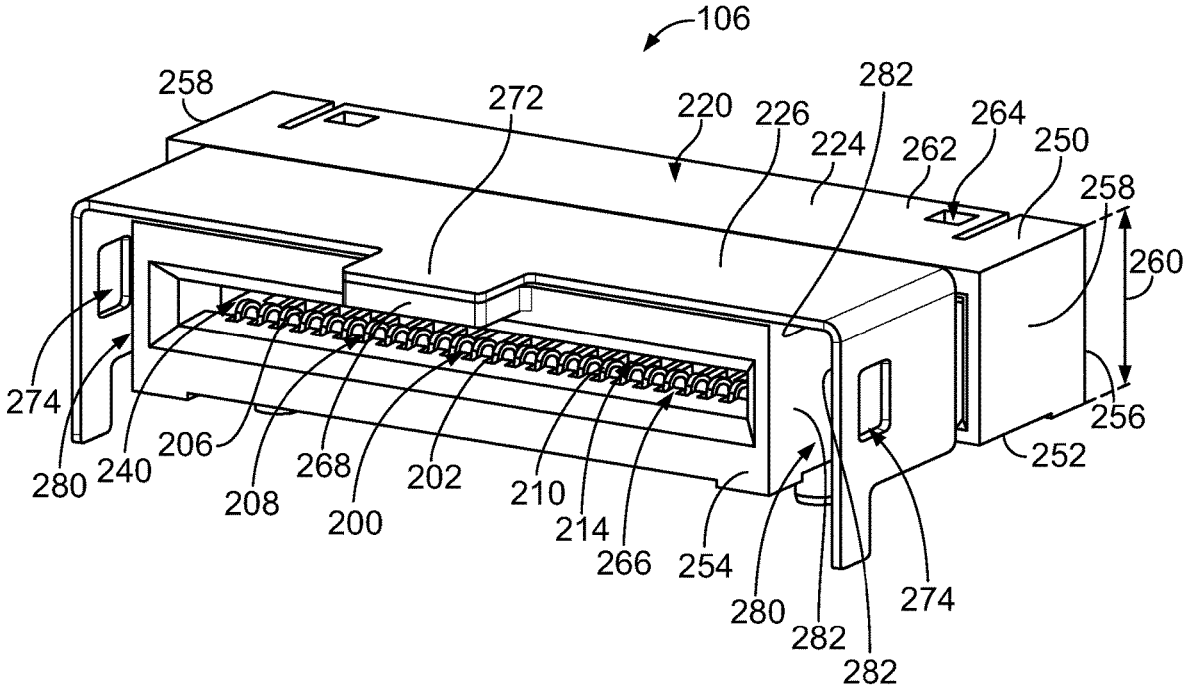
FIG. 6 is a front perspective view of the receptacle connector in accordance with an exemplary embodiment.
Figure 7:
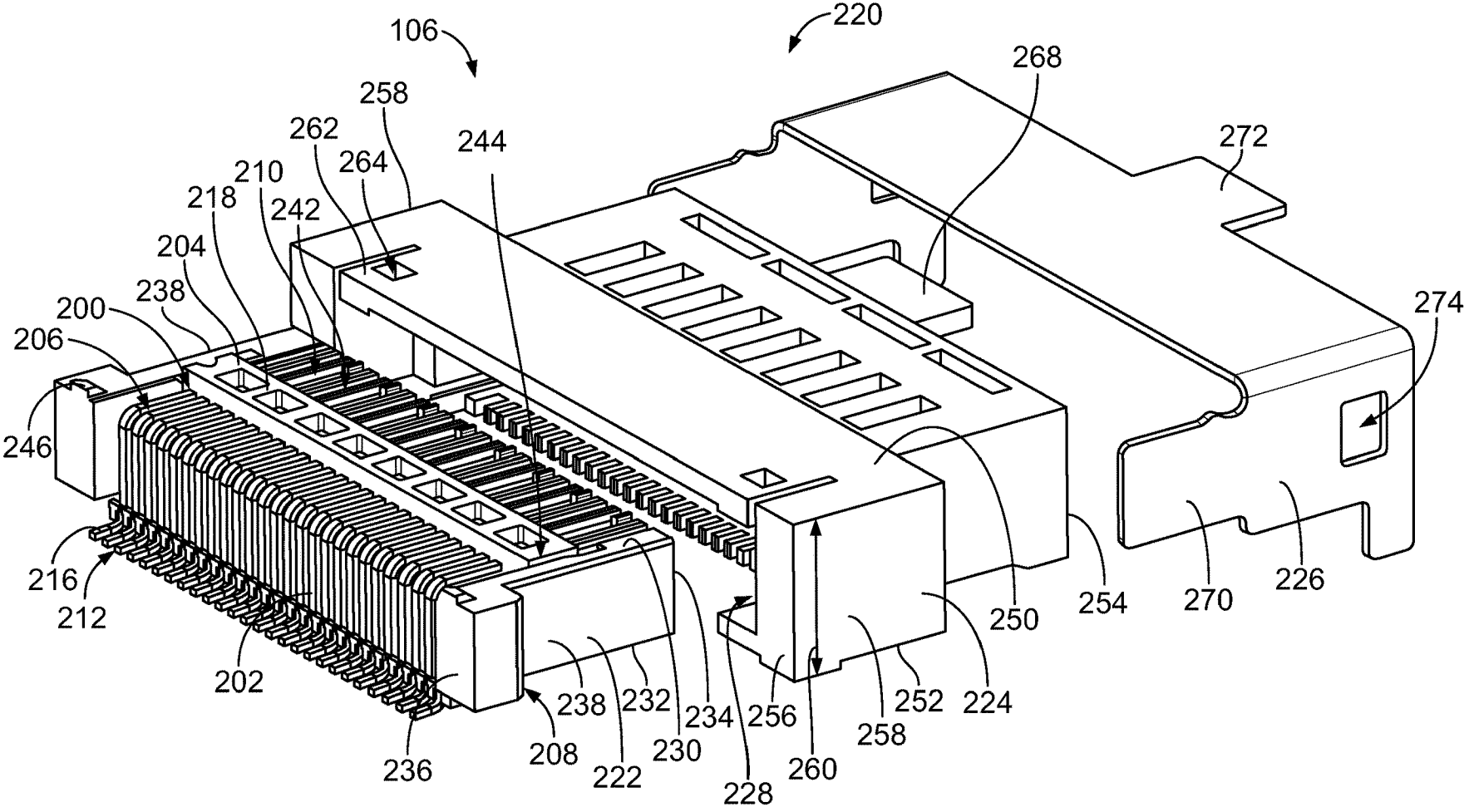
FIG. 7 is an exploded view of the receptacle connector in accordance with an exemplary embodiment.

FIG. 6 is a front perspective view of the receptacle connector 106 in accordance with an exemplary embodiment. FIG. 7 is an exploded view of the receptacle connector 106 in accordance with an exemplary embodiment. The receptacle connector 106 includes a contact assembly 200 and a receptacle connector housing 220 holding the contact assembly 200.

The contact assembly 200 includes receptacle contacts 202 and contact holders 204 holding the receptacle contacts 202. The receptacle contacts 202 are configured to be mated with the plug connector 108 (shown in FIG. 3). The receptacle contacts 202 may be stamped and formed contacts. In various embodiments, the receptacle contacts 202 are formed from a leadframe. The contact holders 204 include dielectric bodies that are overmolded over the receptacle contacts 202, such as over the leadframe. In an exemplary embodiment, the receptacle contacts 202 are arranged in two sets, such as an upper array 206 and a lower array 208. The receptacle contacts 202 in the upper array 206 are held together by a corresponding contact holder 204 and the receptacle contacts in the lower array 208 are held together by a corresponding contact holder 204. The contact holder 204 includes an outer surface 218 spanning across the corresponding array 206, 208. The outer surface 218 may be a top surface or a bottom surface.

In an exemplary embodiment, the receptacle contacts 202 extend between a mating end 210 and a terminating end 212. The mating end 210 is configured to be mated to the plug connector 108. The terminating end 212 is configured to be terminated to the circuit board 102 (shown in FIG. 1). In the illustrated embodiment, the mating end 210 includes a spring beam 214 having a separable mating interface. Other types of mating ends may be provided in alternative embodiments. In the illustrated embodiment, the terminating end 212 includes a tail 216. The tail 216 may soldered to the circuit board 102. Other types of terminating ends may be provided in alternative embodiments. In an exemplary embodiment, the receptacle contacts 202 are right angle contacts having one or more bends such that the mating ends 210 are generally perpendicular to the terminating ends 212.

In an exemplary embodiment, the receptacle connector housing 220 is a multi-piece housing. For example, in the illustrated embodiment, the receptacle connector housing 220 includes an inner housing 222, a front housing 224 and a front shell 226. The front housing 224 includes a cavity 228 that receives the inner housing 222 and the contact assembly 200. The front shell 226 is coupled to the front of the front housing 224 to interface with the plug connector 108.

The inner housing 222 holds the contact assembly 200. For example, the upper and lower arrays 206, 208, with the corresponding contact holders 204, are loaded into the inner housing 222. In various embodiments, the upper array 206 is loaded in from the top of the inner housing 222 and the lower array 208 is loaded in from the bottom of the inner housing 222. The inner housing 222 includes a top 230, a bottom 232, a front 234, a rear 236 and sides 238. The inner housing 222 includes a slot 240 at the front 234 configured to receive a circuit cart of the plug connector 108. The receptacle contacts 202 of the upper array 206 extend into the slot 240 from above and the receptacle contacts 202 of the lower array 208 extend into the slot 240 from below. In an exemplary embodiment, the inner housing 222 includes contact channels 242 that receive the receptacle contacts 202. Separating walls separate the contact channels 242 and position the receptacle contacts 202 relative to each other. In an exemplary embodiment, the inner housing 222 includes holder channels 244 that receive the contact holders 204. The contact holders 204 may be movable within the holder channels 244. In an exemplary embodiment, the outer surfaces 218 of the contact holders 204 may extend beyond the outer surfaces of the inner housing 222, such as above the top 230 and below the bottom 232. The contact holders 204 are configured to interface with the front housing 224 when loaded into the cavity 228. The front housing 224 is used to position the contact holders 204 relative to the inner housing 222. For example, the front housing 224 may press the contact holders 204 inward when the inner housing 222 is loaded into the cavity 228. In an exemplary embodiment, the inner housing 222 includes latches 246 at the rear 236. The latches 246 are used to secure the inner housing 222 in the front housing 224.

The front housing 224 includes a top wall 250, a bottom wall 252, a front 254, a rear 256 and side walls 258. The front housing 224 has a height profile 260 between the top wall 250 and the bottom wall 252. In an exemplary embodiment, the top wall 250 is the upper-most element of the receptacle connector 106. For example, no portion of the receptacle connector 106 extends above the height profile 260. Other components, such as the heat sink, may be located above the top wall 250.

The front housing 224 receives the inner housing 222 through the rear 256. Optionally, the front housing 224 includes crush ribs or other locating features in the cavity 228. The inner housing 222 interfaces with the crush ribs to locate the inner housing 222 in the cavity 228. In an exemplary embodiment, the front housing 224 includes a latch 262 for securing the inner housing 222 in the cavity 228. In the illustrated embodiment, the latch 262 is integral with the front housing 224. For example, the latch 262 may be formed by a portion of the top wall 250. Slots are formed in the top wall 250 such that a portion of the top wall 250 is flexible to form the latch 262. The latch 262 includes latch openings 264 that receive the latches 246 of the inner housing 222. Other types of latches may be used in alternative embodiments. In an exemplary embodiment, the latch 262 is contained within the height profile 260 of the front housing 224.

The front housing 224 includes a card slot 266 at the front 254 configured to receive the circuit card of the plug connector 108. The inner housing 222 is received in the front housing 224 to position the mating ends 210 of the receptacle contacts 202 at the card slot 266. The receptacle contacts 202 are electrically connected to the circuit card when the circuit card is plugged into the card slot 266.

The front housing 224 includes a keying feature 268 at the front 254. The keying feature 268 is used to guide mating with the plug connector 108. In the illustrated embodiment, the keying feature 268 is a tab projecting forward from the front 254. Other types of keying features 268 may be provided in alternative embodiments. In an exemplary embodiment, the keying feature 268 is contained within the height profile 260 of the front housing 224.

The front shell 226 is coupled to the front 254 of the front housing 224. In an exemplary embodiment, the front shell 226 is stamped and formed from a metal sheet. The front shell 226 includes mounting tabs 270 coupled to the front housing 224. For example, the mounting tabs 270 are received in mounting pockets at the side walls 258. In the illustrated embodiment, the front shell 226 is U-shaped having a top and sides. Optionally, the front shell 226 may include a keying feature 272, which may be aligned with the keying feature 268. In an exemplary embodiment, the front shell 226 includes latch openings 274 used to latchably secure the plug connector 108 to the receptacle connector 106.

In an exemplary embodiment, the receptacle connector 106 includes guide pockets 280 configured to receive a portion of the plug connector 108 to guide mating with the plug connector 108. The guide pockets 280 are provided at the first and second sides of the receptacle connector 106, such as flanking both sides of the card slot 266. The guide pockets 280 are formed by guide walls 282. In the illustrated embodiment, the guide walls 282 are formed by the front housing 224 and the front shell 226. For example, the guide pocket 280 is located between the side wall 258 and the side of the front shell 226. The plug connector 108 engages the guide walls 282 to locate the plug connector 108 relative to the receptacle connector 106. The top of the front shell 226 may define one of the guide walls 282. In alternative embodiments, the receptacle connector 106 may be provided without the front shell 226. The front housing 224 may form the guide pockets 280.

Figure 8:
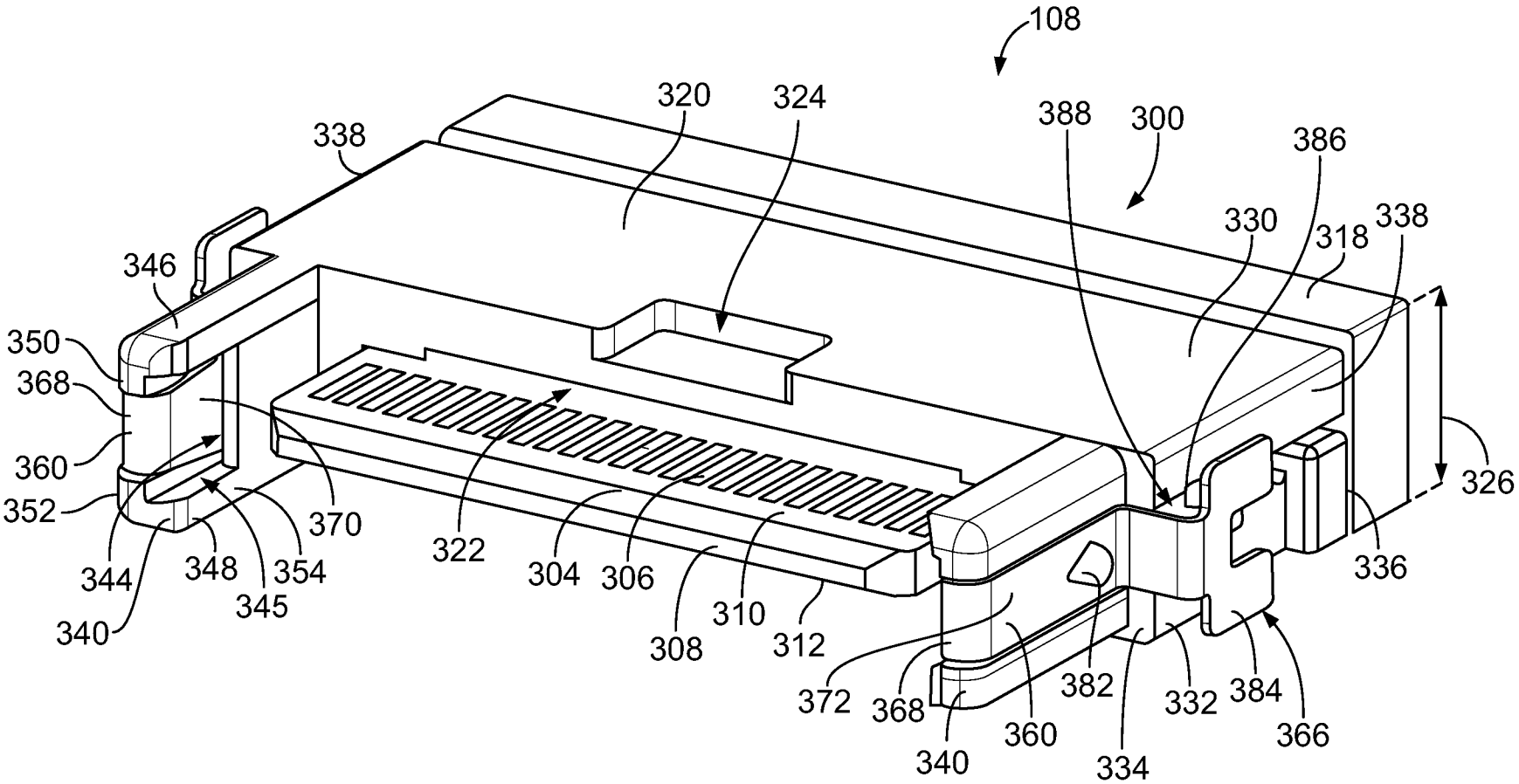
FIG. 8 is a front perspective view of the plug connector in accordance with an exemplary embodiment.
Figure 9:
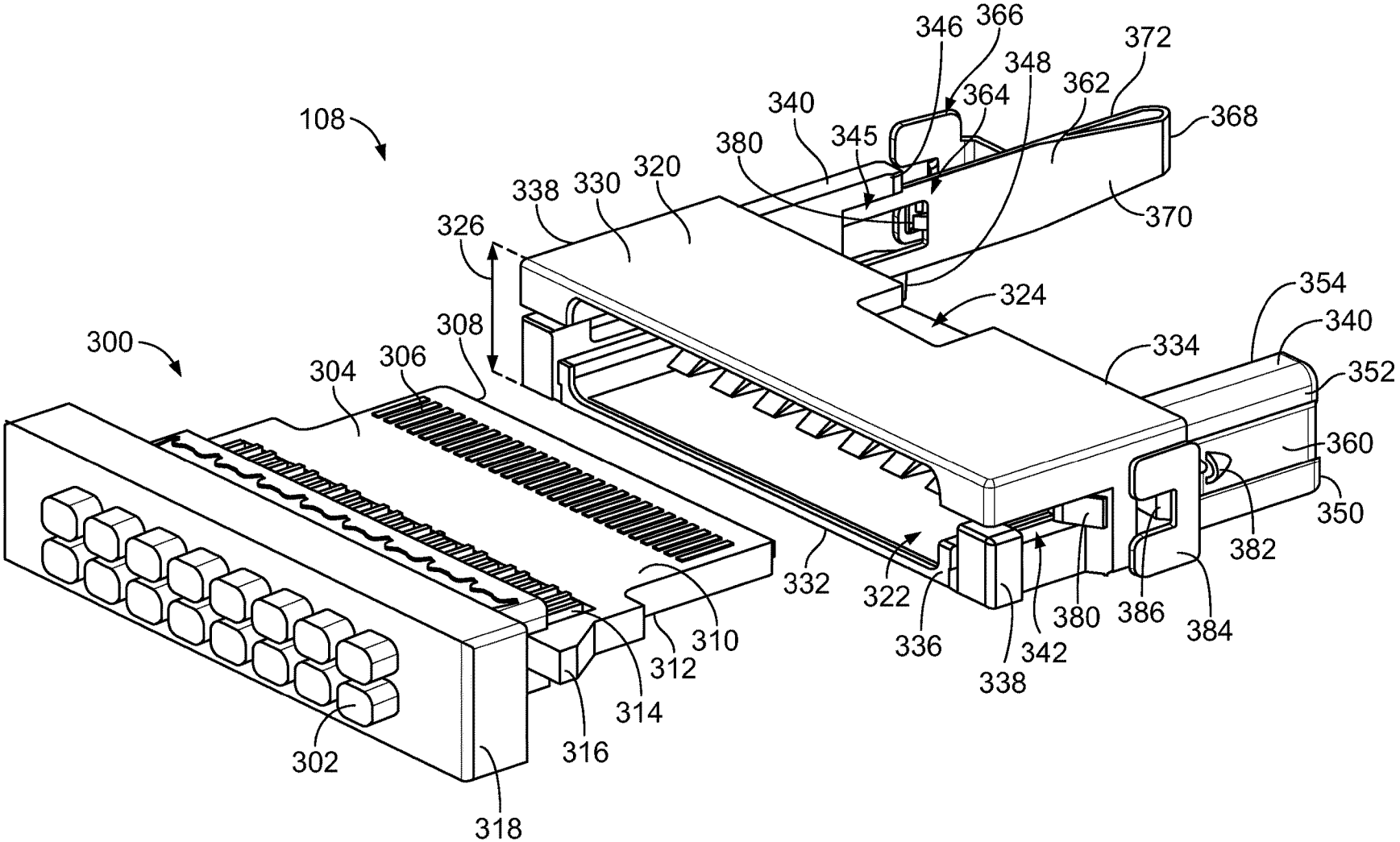
FIG. 9 is an exploded view of the plug connector in accordance with an exemplary embodiment.

FIG. 8 is a front perspective view of the plug connector 108 in accordance with an exemplary embodiment. FIG. 9 is an exploded view of the plug connector 108 in accordance with an exemplary embodiment. The plug connector 108 includes a cable assembly 300, a plug connector housing 320 holding the cable assembly 300 and latches 360 used to secure the plug connector 108 to the receptacle connector 106 (shown in FIG. 6).

The cable assembly 300 includes cables 302 electrically connected to a circuit card 304. In an exemplary embodiment, the circuit card 304 includes plug contacts 306 at a card edge 308 of the circuit card 304. The plug contacts 306 may be provided at an upper surface 310 and a lower surface 312. The cables 302 are terminated to contact pads 314 at the rear of the circuit card 304, such as at both the upper and lower surfaces 310, 312. In an exemplary embodiment, the circuit card 304 includes latching features 316 at sides of the circuit card 304 to secure the circuit card 304 in the plug connector housing 320. In an exemplary embodiment, the cable assembly 300 includes a strain relief member 318 for the cables 302. The strain relief member 318 may be overmolded over the cables 302. Optionally, the strain relief member 318 may be overmolded over the rear of the circuit card 304.

The plug connector housing 320 includes a cavity 322 that receives the cable assembly 300. The plug connector housing 320 includes an upper wall 330, a lower wall 332, a front wall 334, a rear wall 336 and side walls 338. In an exemplary embodiment, the plug connector housing 320 has a height profile 326 defined between the upper wall 330 and the lower wall 332. The upper wall 330 is the upper-most element of the plug connector 108 and the lower wall 332 is the lower-most element of the plug connector 108. For example, no portion of the plug connector 106 extends above the height profile 326 or below the height profile 326. Other components, such as the heat sink, may be located above the upper wall 330.

In an exemplary embodiment, the plug connector housing 320 includes alignment embossments 340 extending forward of the front wall 334. The alignment embossments 340 are used to align the plug connector 108 with the receptacle connector 106 during mating. The alignment embossments 340 are configured to be loaded into the guide pockets 280 to align the plug connector 108 with the receptacle connector 106. The alignment embossments 340 engage the guide walls 282 to control side-to-side positioning and/or vertical positioning of the plug connector 108. The alignment embossments 340 ensure proper alignment of the circuit card 304 with the card slot 266 (shown in FIG. 6) for loading the circuit card 304 in the card slot 266. In an exemplary embodiment, the alignment embossments 340 are contained within the height profile 326 of the plug connector housing 320.

In an exemplary embodiment, the plug connector housing 320 includes a keying feature 324 at the front. The keying feature 324 is used to ensure proper mating with the receptacle connector 106. In the illustrated embodiment, the keying feature 324 is a pocket formed in the upper wall 330, which is open at the front wall 334 to receive the keying feature 268 (shown in FIG. 6) of the receptacle connector 106. Other types of keying features 268 may be provided in alternative embodiments, such as a projecting tab. In an exemplary embodiment, the keying feature 324 is contained within the height profile 326 of the plug connector housing 320.

In an exemplary embodiment, the cavity 322 is open at the rear wall 336 and the front wall 334. The circuit card 304 is loaded into the cavity 322 through the rear wall 336. The plug connector housing 320 includes latching pockets 342 in the side walls 338 that receive the latching features 316 at the sides of the circuit card 304 to secure the circuit card 304 in the cavity 322. In an exemplary embodiment, the circuit card 304 protrudes from the front wall 334 for loading into the card slot 266. The alignment embossments 340 flank both sides of the circuit card 304. In an exemplary embodiment, the alignment embossments 340 extend forward of the card edge 308 of the circuit card 304 such that the alignment embossments 340 interface with the receptacle connector 106 prior to the circuit card 304 being loaded into the card slot 266.

In an exemplary embodiment, the latches 360 are coupled to the alignment embossments 340. In an exemplary embodiment, the latches 360 are contained within the height profile 326 of the plug connector housing 320. The latches 360 are received in latch channels 344 (FIG. 8) formed in the alignment embossments 340 and/or the side walls 338. In an exemplary embodiment, each alignment embossment 340 includes a window 345 between an upper arm 346 and a lower arm 348. The window 345 is open at a distal end 350 of the alignment embossment 340. The window 345 receives a portion of the latch 360. In an exemplary embodiment, the latch 360 is movable relative to the alignment embossment 340 within the window 345. For example, when the latch 360 is actuated, the latch 360 may move inward into the window 345, such as to release the latch 360 from the receptacle connector 106.

The latches 360 are coupled to the alignment embossments 340. The latches 360 are received in the latch channels 344 and the windows 345. The latches 360 extend to the distal ends 350 of the alignment embossments 340. In an exemplary embodiment, each latch 360 extends along an outer surface 352 of the alignment embossment 340, such as for interfacing with the receptacle connector 106. Additionally, or alternatively, the latch 360 may extend along an inner surface 354 of the alignment embossment 340.

Figure 10:
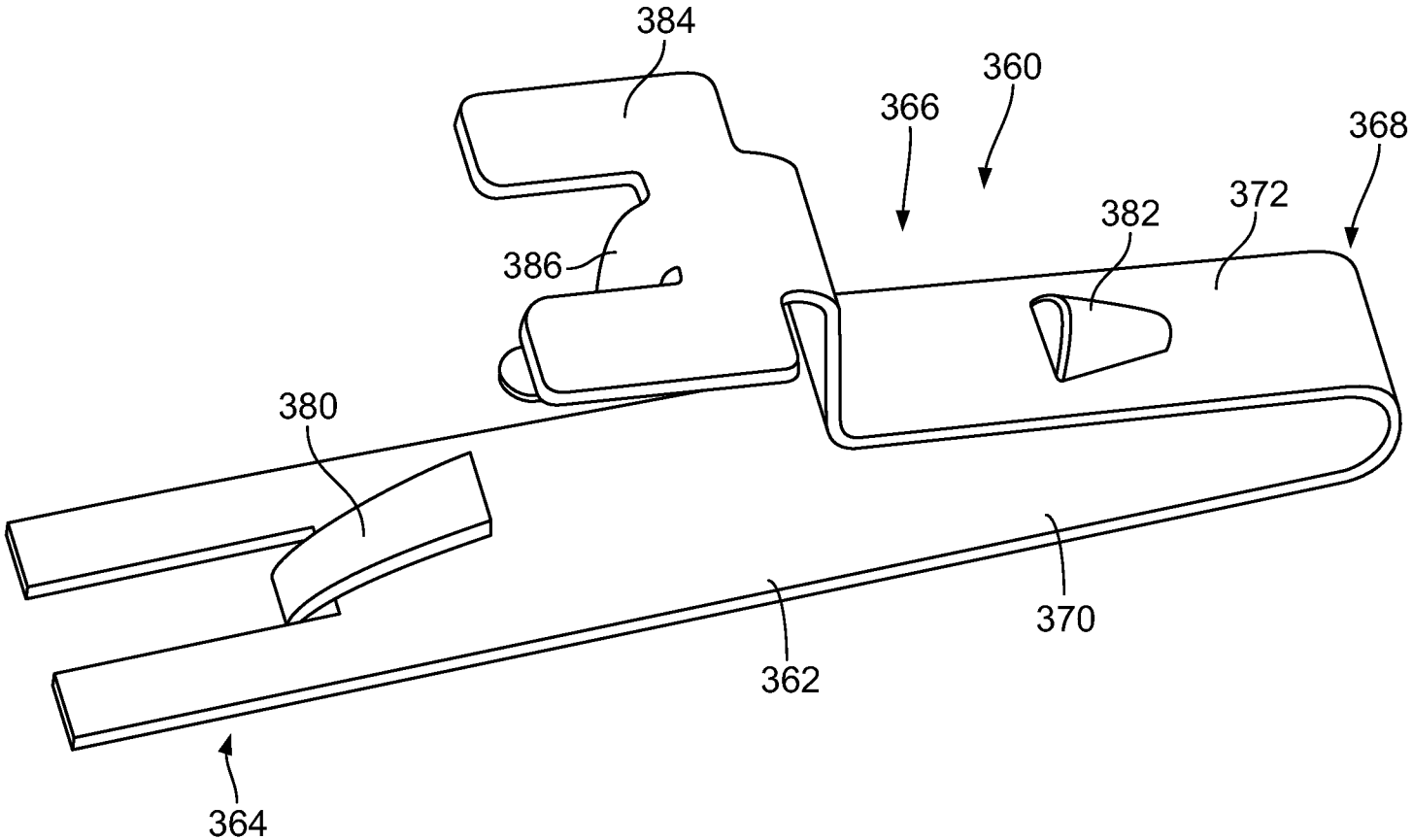
FIG. 10 is a perspective view of a latch of the plug connector in accordance with an exemplary embodiment.

With additional reference to FIG. 10, which is a perspective view of the latch 360 in accordance with an exemplary embodiment, the latch 360 includes a latch body 362 having a mounting end 364 and a latching end 366 with a spring portion 368 between the mounting end 364 and the latching end 366. The latch body 362 includes an inner arm 370 extending between the spring portion 368 and the mounting end 364. The latch body 362 includes an outer arm 372 extending between the spring portion 368 and the latching end 366. The spring portion 368 is folded over such that the outer arm 372 extends generally parallel to and spaced apart from the inner arm 370. The spring portion 368 allows the latching end 366 to deflect relative to the mounting end 364 when the latch is actuated to release the latching end 366 from the receptacle connector 106. For example, when actuated, the latching end 366 is moved inward. The spring portion 368 returns the latching end 366 to a latching position when the latch 360 is released. For example, when released, the latching end 366 moves outward. In an exemplary embodiment, the latch body 362 is wrapped around at the front end of the latch 360 (forming the spring portion 368) to prevent stubbing or damaging the latch 360 during mating with the receptacle connector 106.

The mounting end 364 is configured to be mounted to the plug connector housing 320. For example, the mounting end 364 is received in the latch channel 344. In an exemplary embodiment, the latch 360 includes a retention tab 380 at the mounting end 364 configured to be latchably coupled to the plug connector housing 320. For example, the retention tab 380 may be stamped and formed from the mounting end 364 being bent outward to clip into the latching pocket 342 to engage the plug connector housing 320 and secure the latch 360 in the plug connector housing 320. The retention tab 380 prevents pull out of the latch 360 from the latch channel 344. However, the retention tab 380 may be released to allow removal.

The latching end 366 includes a latching tab 382 extending outward from the outer arm 372 to latchably engage the receptacle connector 106. For example, the latching tab 382 may be received in the latch opening 274 (shown in FIG. 6) to latchably secure the plug connector 108 to the receptacle connector 106. The latching tab 382 may be stamped and formed from the outer arm 372. The latching end 366 may be released from the latch opening 274 by pressing the latching end 366 inward. The outer arm 372 is moved inward into the window 345 when actuated.

The latching end 366 includes a release tab 384 at a distal end of the outer arm 372. The release tab 384 may be bent outward such that a press area of the release tab 384 is spaced apart from the plug connector housing 320 and allowed to be pressed inward to release the latching end 366. The release tab 384 extends along, spaced apart from, the side wall 338 and is movable toward the side wall 338 when actuated. In an exemplary embodiment, the release tab 384 includes a hook 386 bent inward toward the plug connector housing 320. The hook 386 is received in a slot 388 formed in the side wall 338. The hook 386 engages the plug connector housing 320 to prevent pulling the latching end 366 outward away from plug connector housing 320, such as to prevent damaging the latch 360. The spring portion 368 may outwardly bias the latching end 366 to press the hook 386 against the plug connector housing 320.

Returning to FIGS. 3 and 4, during mating, the plug connector 108 is aligned with the receptacle connector 106. The alignment embossments 340 are aligned with the guide pockets 280. As the alignment embossments 340 are loaded into the guide pockets 280, the alignment embossments 340 engage the guide walls 282 to position the plug connector 108 relative to the receptacle connector 106. The guide walls 282 guide mating of the plug connector 108 with the receptacle connector 106. The alignment embossments 340 align the circuit card 304 with the card slot 266 prior to loading the circuit card 304 into the card slot 266.

When mated, the latching tabs 382 of the latches 360 are received in the latch openings 274 to secure the plug connector 108 to the receptacle connector 106. The latches 360 may be released by actuating the release tabs 384, such as by pressing the release tabs 384 inward. In an exemplary embodiment, the release tabs 384 may be released by hand, such as by squeezing the release tabs 384 inward. In alternative embodiments, a release tool may be used, such as a comb-like structure that is slid along the connectors to engage and release the release tabs 384. In other various embodiments, a tether or other releasing structure may be coupled to the release tabs to release the release tabs 384. For example, a tether may be coupled to the release tabs 384 and extend across the top of the plug connector 108, which may be pulled upward to squeeze the release tabs 384 inward and release the latches 360.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A communication system comprising:

a receptacle connector including a contact assembly and a receptacle connector housing holding the contact assembly, the contact assembly including receptacle contacts arranged in an upper array and a lower array, the receptacle contacts including spring beams at mating ends of the receptacle contacts, the contact assembly including contact holders holding the receptacle contacts in the upper array and the lower array, the receptacle connector housing including a front housing and an inner housing receiving the contact holders and the receptacle contacts, the front housing including a top wall and a bottom wall forming a cavity therebetween, the front housing including a card slot at a front of the receptacle connector housing, the inner housing being received in the cavity of the front housing to position the mating ends of the receptacle contacts at the card slot, the front housing retaining the contact holders in the inner housing, the front housing including a housing latch securing the inner housing in the front housing, the receptacle connector housing having guide pockets at the front, wherein the receptacle connector housing includes a height profile defined between the top wall and the bottom wall, the housing latch being contained within the height profile, the inner housing being contained within the height profile, the guide pockets being contained within the height profile; and a plug connector mated with the receptacle connector, the plug connector including a plug connector housing having an upper wall, a lower wall and side walls between the upper and lower walls forming a cavity, the cavity receives a cable assembly of the plug connector, the cable assembly having cables electrically connected to a circuit card, the circuit card having a card edge and plug contacts proximate to the card edge, the circuit card being received in the card slot of the receptacle connector to mate the plug contacts with the receptacle contacts, the plug connector housing includes alignment embossments extending forward from the side walls, the alignment embossments being received in the guide pockets of the receptacle connector to align the plug connector with the receptacle connector prior to loading the circuit card in the card slot, the plug connector including latches coupled to the alignment embossments being latchably coupled to the receptacle connector, wherein the latches are contained within a height profile of the plug connector housing defined between the upper wall and the lower wall of the plug connector housing.

2. The communication system of claim 1, wherein the height profile of the plug connector is approximately equal to the height profile of the receptacle connector.

3. The communication system of claim 1, wherein the receptacle connector includes a receptacle connector keying feature contained within the height profile of the receptacle connector, the plug connector including a plug connector keying feature interfacing with the receptacle connector keying feature to orient the plug connector relative to the receptacle connector, the plug connector keying feature being contained within the height profile of the plug connector.

4. The communication system of claim 1, wherein the receptacle connector housing includes guide walls defining the guide pockets, the alignment embossments engaging the guide walls to orient the plug connector relative to the receptacle connector.

5. The communication system of claim 1, wherein the receptacle connector housing further comprises a front shell coupled to the front housing, the front shell being contained within the height profile of the receptacle connector, the guide pockets being defined between the front shell and the front housing.

6. The communication system of claim 1, wherein the receptacle connector housing further comprises a front shell coupled to the front housing, the front shell including latch openings, the latches of the plug connector being received in the latch openings to secure the plug connector to the receptacle connector.

7. The communication system of claim 1, wherein the housing latch is integral with the top wall of the front housing, the housing latch being deflectable relative to the top wall of the front housing.

8. The communication system of claim 1, wherein the contact holders include dielectric bodies overmolded over the receptacle contacts, the contact holders being movable relative to the inner housing, the contact holders engaging the front housing to position the contact holders relative to the inner housing.

9. The communication system of claim 1, wherein the circuit card extends forward of a front wall of the plug connector housing for loading into the card slot of the receptacle connector housing, the alignment embossments extending forward of the front wall such that distal ends of the alignment embossments are located forward of the card edge of the circuit card to engage the receptacle connector prior to the circuit card being loaded into the card slot.

10. The communication system of claim 1, wherein each alignment embossment includes a window between an upper arm and a lower arm, the latches being movable in the corresponding windows when the latches are released.

11. The communication system of claim 1, wherein each latch of the plug connector includes an inner arm secured to the corresponding alignment embossment and an outer arm extending from the inner arm, the latch being folded such that the outer arm extends generally parallel to and spaced apart from the inner arm with a spring arm between the inner arm and the outer arm, the outer arm having a latching tab extending outward from the outer arm to latchably engage the receptacle connector.

12. The communication system of claim 11, wherein the latch further comprises a release tab extending from the outer arm, the release tab being actuated inward to release the latching tab from the receptacle connector.

13. A plug connector comprising:

a cable assembly including cables electrically connected to a circuit card, the circuit card having a card edge and plug contacts proximate to the card edge, the circuit card configured to be received in a card slot of a receptacle connector;

a plug connector housing including an upper wall, a lower wall and side walls at first and second sides of the plug connector housing, the side walls extending between the upper and lower walls forming a cavity between the side walls, the cavity receives the circuit card, the plug connector housing includes a height profile defined between the upper wall and the lower wall, the plug connector housing includes alignment embossments extending forward from the side walls, the alignment embossments being configured to interface with the receptacle connector to align the plug connector with the receptacle connector prior to loading the circuit card in the card slot;

latches coupled to the alignment embossments along the first and second sides, the latches configured to be latchably coupled to the receptacle connector, wherein the latches are contained within the height profile of the plug connector housing, the latches being actuated to release the latches by pressing the latches inward from the first and second sides of the plug connector housing.

14. The plug connector of claim 13, wherein the circuit card extends forward of a front wall of the plug connector housing for loading into the card slot of the receptacle connector housing, the alignment embossments extending forward of the front wall such that distal ends of the alignment embossments are located forward of the card edge of the circuit card to engage the receptacle connector prior to the circuit card being loaded into the card slot.

15. The plug connector of claim 13, wherein each alignment embossment includes a window between an upper arm and a lower arm, the latches being movable in the corresponding windows when the latches are released.

16. The plug connector of claim 13, wherein each latch of the plug connector includes an inner arm secured to the corresponding alignment embossment and an outer arm extending from the inner arm, the latch being folded such that the outer arm extends generally parallel to and spaced apart from the inner arm with a spring arm between the inner arm and the outer arm, the outer arm having a latching tab extending outward from the outer arm to latchably engage the receptacle connector.

17. A receptacle connector for a communication system comprising:

a contact assembly including receptacle contacts arranged in an upper array and a lower array, the contact assembly including contact holders holding the receptacle contacts in the upper array and the lower array, the receptacle contacts including spring beams at mating ends of the receptacle contacts;

a receptacle connector housing holding the contact assembly, the receptacle connector housing including a front housing and an inner housing, the inner housing receiving the contact holders and the receptacle contacts, the front housing including a top wall and a bottom wall forming a cavity therebetween, the front housing including a card slot at a front of the receptacle connector housing configured to receive a plug circuit card of a plug connector, the inner housing being received in the cavity of the front housing to position the mating ends of the receptacle contacts at the card slot for mating with the plug circuit card, the front housing retaining the contact holders in the inner housing, the front housing including a housing latch securing the inner housing in the front housing, the receptacle connector housing having a guide pocket configured to receive the plug connector to locate the plug connector relative to the receptacle connector, wherein the receptacle connector housing includes a height profile defined between the top wall and the bottom wall, the housing latch being contained within the height profile, the inner housing being contained within the height profile, the guide pocket being contained within the height profile.

18. The receptacle connector of claim 17, wherein the receptacle connector housing includes guide walls defining the guide pockets, the guide walls configured to orient the plug connector relative to the receptacle connector.

19. The receptacle connector of claim 17, wherein the receptacle connector housing further comprises a front shell coupled to the front housing, the front shell being contained within the height profile of the receptacle connector, the guide pockets being defined between the front shell and the front housing.

20. The receptacle connector of claim 17, wherein the receptacle connector housing further comprises a front shell coupled to the front housing, the front shell including latch openings configured to receive latches of the plug connector to secure the plug connector to the receptacle connector.

21. The receptacle connector of claim 17, wherein the housing latch is integral with the top wall of the front housing, the housing latch being deflectable relative to the top wall of the front housing.

22. The receptacle connector of claim 17, wherein the contact holders include dielectric bodies overmolded over the receptacle contacts, the contact holders being movable relative to the inner housing, the contact holders engaging the front housing to position the contact holders relative to the inner housing.

* * * * *